United States Patent [19]

Tajiri et al.

[11] Patent Number: 4,608,736

[45] Date of Patent: Sep. 2, 1986

[54] APPARATUS FOR MANUFACTURING A BULKY TEXTURED YARN

[75] Inventors: Koji Tajiri, Mihara; Toshiharu Arimatu, Ibaraki, both of Japan

[73] Assignee: Teijin Limited, Osaka, Japan

[21] Appl. No.: 493,980

[22] Filed: May 12, 1983

Related U.S. Application Data

[60] Continuation-in-part of Ser. No. 245,121, Mar. 18, 1981, Pat. No. 4,404,718, which is a division of Ser. No. 15,904, Feb. 28, 1979, abandoned.

[30] Foreign Application Priority Data

Mar. 7, 1978 [JP] Japan ..... 53-24933

[51] Int. Cl.[4] ..... D02G 1/16

[52] U.S. Cl. ..... 28/220; 28/241; 28/250

[58] Field of Search ..... 28/241, 248, 250, 251, 28/220, 221

[56] References Cited

U.S. PATENT DOCUMENTS

| | | | |
|---|---|---|---|
| 3,143,784 | 8/1964 | Scott | 28/220 |
| 3,509,595 | 5/1970 | Mader, Jr. et al. | 28/241 X |
| 3,636,600 | 1/1972 | Mertens | 28/220 |
| 3,654,677 | 4/1972 | Binford et al. | 28/220 |
| 3,831,231 | 8/1974 | Binford et al. | 28/220 |
| 3,961,402 | 6/1976 | Ferrier et al. | 28/250 |
| 4,012,816 | 3/1977 | Hatcher | 28/248 |
| 4,014,085 | 3/1977 | Fink et al. | 28/248 |
| 4,043,010 | 8/1977 | Gorrafa | 28/220 |
| 4,135,511 | 1/1979 | Nikkel | 28/248 X |
| 4,162,564 | 7/1979 | Stanley | 28/248 |

FOREIGN PATENT DOCUMENTS

| | | | |
|---|---|---|---|
| 51-70353 | 6/1976 | Japan . | |
| 1161674 | 8/1969 | United Kingdom | 28/250 |

*Primary Examiner*—Robert R. Mackey

*Attorney, Agent, or Firm*—Burgess, Ryan & Wayne

[57] ABSTRACT

Apparatus for manufacturing a bulky textured yarn from a thermoplastic multifilament yarn by applying a pressurized heated fluid in a condition of automatically controlling the operating characters of the texturing operation. During the steady operational condition of manufacturing the bulky textured yarn, the yarn tension is continuously detected in a drafting zone between a texturing device and a winding device, and the operating characteristics, such as surface temperature of the heating roller and, temperature of the pressurized heated fluid supplied to the texturing device which affect the shrinkage of the processing yarn passing through the texturing device are automatically adjusted so as to control the yarn tension in the drafting zone. To eliminate the causes which degrade the dyeability of the textured yarn produced in a period of carrying out a threading operation through the texturing device, the heating roller is preheated at a temperature higher than the set temperature thereof in the period of carrying out the steady continuous operation of the texturing device, and the set temperature of the heating roller is gradually lowered to that utilized during steady continuous operation, for a short time, for example 60 seconds.

5 Claims, 11 Drawing Figures

APPARATUS FOR MANUFACTURING A BULKY TEXTURED YARN

SUMMARY OF THE INVENTION

This is a continuation-in-part application of patent application Ser. No. 245,121, filed Mar. 18, 1981, now U.S. Pat. No. 4,404,718, granted Sept. 20, 1983, which application is a division of U.S. Patent Application Ser. No. 015,904, filed Feb. 28, 1979, now abandoned.

The present invention relates to a method and an apparatus for manufacturing a bulky textured yarn from a thermoplastic multifilament yarn by applying a pressurized heated fluid, particularly the manufacturing method and apparatus which is applied to the entire period required for texturing a multifilament yarn, which involves a time of carrying out the so-called threading operation of the yarn through a texturing apparatus and a time of steady continuous operation for texturing the yarn.

The bulky treatment of multifilament yarns of thermoplastic synthetic filaments utilizing a pressurized heated fluid recently has attracted attention in the art because of various advantages created by this texturing treatment. For example, the treatment-speed can be increased very easily, crimps formed on constituent individual filaments have a three-dimensional random structure, and bulky yarns having a high utility as face yarns of carpets and the like can be obtained. Accordingly, various methods for carrying out this treatment have been proposed. For example, typical processes are disclosed in Japanese Patent Publication No. Showa 45(1970)-24699, Japanese Patent Publication No. Showa 44(1969)-13226, Japanese Patent Application Laid-Open Specification No. Showa 46(1971)-2180 and Japanese Patent Publication No. Showa 46(1971)-23766.

In the above mentioned methods for manufacturing the bulky multifilament yarn by utilizing a pressurized heated fluid, individual filaments of the yarn to be processed undergo a violent contracting action in a short time in a processing nozzle and/or after delivered from the processing nozzle. Accordingly, changes in the quality of the resulting bulky yarn due to the shrinking property of the yarn to be processed, the possible change of processing conditions such as the preheating temperature of the heating elements, and the temperature and pressure of the fluid are more conspicuous than in other crimping treatments (for example, the mechanical stuffing method, the gear processing method, and the frictional contact processing method). This is a serious defect in the conventional bulky treatments utilizing a pressurized heated fluid. In these conventional methods, yarns are orinarily wound on a bobbin after the textured yarn has been drafted among a pulrality of rollers or a plurality of tension roller pins. It has been found that there is a very close correlation between the above-mentioned change of the quality and the variation of a yarn tension at this drafting step. From this viewpoint, there has been proposed a process in which a tension detector is disposed in a drafting zone to detect an abnormal tension. For example, Japanese Patent Application Laid-Open Specification No. 70353/76 discloses such a system. However, in such a proposed system, only abnormal yarns which are detected based upon the detection of the abnormal yarn tension are removed and consequently, such a system is not satisfactory as a means for positively producing uniform bulky yarns.

The primary object of the present invention is to provide a unique method for manufacturing a bulky textured yarn from a thermoplastic multifilament yarn by which the above-mentioned drawbacks of the conventional method can be eliminated.

As hereinbefore explained, methods for manufacturing the bulky textured multifilament yarn are well known. However, according to the experience of the inventors of the present invention, it has been found that in these methods the quality of yarn is not stable immediately after the so-called threading operation through the texturing apparatus. For example, the dyeability of the textured yarn involved in an initial winding portion of a yarn package is so weakened that a possible irregular dyeing effect may develop and consequently, the initial winding portion of the yarn package must be removed. This defect is more remarkable as the thickness of the individual filaments of the yarn increases, and if the speed of the operation is also increased, the resulting increase in the production cost becomes very large. A further object of the present invention is to provide a method for manufacturing a bulky textured yarn from a thermoplastic multifilament yarn by which the above-mentioned drawback of the conventional method due to the threading operation is substantially eliminated. According to the present invention, a very desirable and practical method for manufacturing a bulky textured yarn from a thermoplastic multifilament yarn, over the entire period required for production, involving the period for threading the yarn through the texturing apparatus and the period for carrying out the steady operation, is introduced in the art.

To attain the primary purpose of the present invention, fundamental research has been conducted to find a method of producing a bulky textured yarn having a uniform quality in the steady continuous texturing operation. As a result of the research, it was found that the yarn tension in the drafting zone between the texturing process and the winding process mainly depends upon the surface temperature of the heating roller which feeds a multifilament yarn to a texturing member and/or the thermal factors, i.e. the temperature and the pressure, of the pressurized heated fluid applied to the texturing member. In other words, the operational conditions of the elements of the texturing apparatus can be effectively controlled according to the above-mentioned result of the research. That is, in the present invention, a yarn of thermoplastic synthetic filaments is subjected to a bulky treatment with a pressurized heated fluid through a mechanism provided with a heating roller and after the above-mentioned bulky treatment, the processed yarn is drafted in the drafting zone upstream of the winding mechanism. The tension of the yarn in the drafting zone is detected and the temperature of the heating roller or the pressure or temperature of the pressurized heated fluid is controlled based on results of the tension detection so that the above-mentioned yarn tension is controlled so that it is maintained at a predetermined level. The primary object of the present invention is attained by the above-mentioned tension control of the yarn. To solve the above-mentioned second problem, the causes of the second problem were studied, and it was found that the second problem depends upon the following causes. That is (a) since a door of an exhaust chamber of a texturing apparatus is opened at the time of threading, a supplied yarn through the texturing apparatus, the surface temperature of a heating roller disposed in the exhaust chamber is lowered and, consequently, the temperature of the yarn supplied into a texturing nozzle is lowered, (b) since the supply of the heated fluid into the texturing nozzle is stopped or the supply rate of the heated fluid into the texturing nozzle is decreased during the threading operation of the yarn through the texturing nozzle, the temperature of the texturing nozzle is lowered and, accordingly, it is necessary to allow a certain amount of time to elapse to recover the temperature of the texturing nozzle to a steady condition, (c) since the surface temperature of a separate roller facing the heating roller is low at a time before threading the yarn thereto, and the surface temperature thereof is elevated after threading the yarn thereto, heat energy contained in the yarn is transferred to the separate roller during the period of elevating the surface temperature thereof, in other words, the substantial temperature of the yarn fed to the texturing nozzle is lowered during the above-mentioned period, (d) the distributions of the surface temperature of the heating roller before and after threading the yarn thereto are different from each other, and it is necessary to allow a certain amount of time to elapse to stabilize the distribution of the surface temperature after the completion of the threading operation, and consequently, the substantial temperature of the yarn supplied to the texturing nozzle is lowered before the above-mentioned distribution of the surface temperature of the heating roller is stabilized.

Since the above-mentioned causes are combined in a complex manner, counteractions to eliminate the above-mentioned causes were tried in the art, for example, a separate roller of the heated type was utilized, or the time for stopping the supply of heated fluid into the texturing nozzle was shortened as much as possible, or the threading operation was carried out without stopping the supply of heated fluid into the texturing nozzle. However, the inventors of the present invention found that the above-mentioned several counteractions were not sufficient to solve the second problem. Therefore, several experimental tests were repeated to solve the second problem and as a result, it was found that if the surface temperature of the heating roller is set at a temperature higher than the surface temperature thereof in a steady continuous texturing operation at the time of the threading operation, and thereafter the above-mentioned set temperature is gradually lowered to the steady condition, the above-mentioned second problem can be substantially solved. That is, the second object of the present invention is attained by the following temperature control method applied to the texturing apparatus at the time of threading the yarn through the apparatus. THe temperature control method comprises preheating the heating roller in a condition of setting a surface temperature thereof for example no lower 5° C. than the set temperature corresponding to the surface temperature thereof, carrying out the threading operation through the texturing apparatus in the above-mentioned setting condition of the surface temperature of the heating roller, lowering the surface temperature of the heating roller to the steady condition thereof right after completion of the threading operation or gradually lowering the surface temperature of the heating roller so that it attains the steady temperature condition thereof. To carry out the above-mentioned method according to the present invention, in the apparatus of the present invention, a tension detector is disposed along the yarn passage between the texturing device and the winding mechanism by which the tension of the textured yarn can be continuously detected, an automatic control system which is operated by a signal based upon the detected signal of the above-mentioned tension detector is utilized to maintain the tension of the textured yarn in an allowable condition so that a textured yarn having uniform qualities can be produced. This automatic control system comprises a tension setting device for setting a predetermined condition of the above-mentioned yarn tension, means for detecting deviation between an electric signal indicative of a value of the yarn tension detected by the tension detector and a set value of the tension setting device, a first means for controlling at least one of treating conditions of the texturing device, such as the temperature or the pressure of the heated fluid or the temperature of the preheating member, i.e., a feed roller, a second means for controlling treatment conditions, such as the tension in the yarn, which affect thermal shrinkage of the yarn while being processed by the texturing device under predetermined conditions. The second control means involves the first control means being capable of working independently, an adjustment device for issuing a control signal corresponding to an output signal of the above-mentioned first control means for detecting deviation, and an output of the adjusting means is connected to the first control means so that when the yarn tension detected by the tension detector is deviated from the set value, the first control means is controlled by a signal issued from the adjusting means, consequently, at least one of the treatment conditions of the texturing means is adjusted in accordance with the control signal of the adjusting means and the yarn tension can be maintained at a desired condition corresponding to the set value.

The above-mentioned apparatus according to the present invention is further provided with means for compensating for the possible lowering of the surface temperature of the heating roller utilized in the texturing means. This compensating means works to preheat the heating roller at a setting temperature thereof $\Delta T$ higher than the setting temperature of the heating roller for carrying out the texturing operation in steady condition before threading the yarn through the texturing device, and works to gradually lower the setting temperature of the heating roller to the setting temperature for carrying out the texturing operation in steady condition in a predetermined short period such as 60 seconds.

In the practical apparatus of the present invention, a thread cutter and a detector for detecting a yarn breakage are also disposed along the yarn passage, and these devices are functionally connected to the above-mentioned automatic control system and the compensation system.

BRIEF DESCRIPTION OF THE DRAWINGS

FIG. 16 is a diagrammatical representation of the distribution of the surface temperature of the heating roller utilized for the texturing apparatus illustrated in FIG. 1.

FIG. 17 is a diagrammatical representation regarding the programing control of the surface temperature of the heating roller utilized for the texturing apparatus illustrated in FIG. 1, and the change of dyeability of the textured multifilament yarn with the lapse of time.

DETAILED DESCRIPTION OF THE SEVERAL EMBODIMENTS OF THE PRESENT INVENTION

Figure 1:
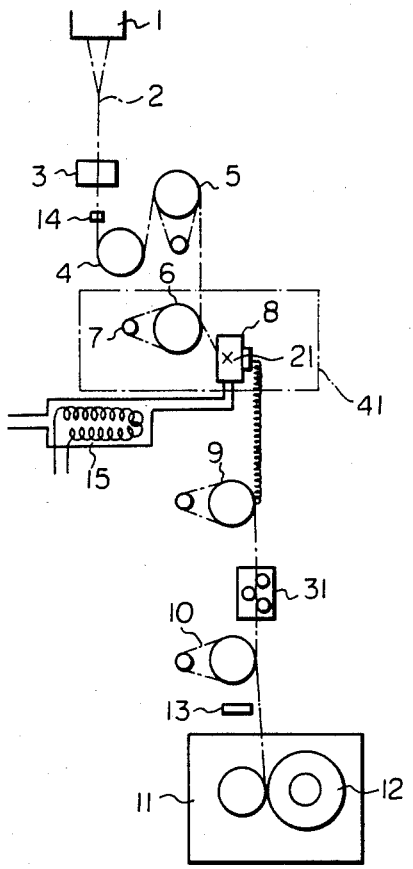
FIG. 1 is a schematic front view of the texturing apparatus utilizing pressurized heated fluid, combined with an apparatus for direct spin draw processing, to which the control method of the present invention is applied.

As hereinbefore explained, the object of the present invention is to eliminate or moderate uneven dyeability or crimp unevenness inherent in a yarn which has been subjected to a bulky treatment utilizing a pressurized heated fluid. The uneven dyeability in yarn which has been subjected to a bulky treatment during the steady continuous texturing operation is more conspicuous than in yarn obtained by other processing treatments such as the false-twisting treatment and frictional contact treatment. As a result of research directed towards eliminating the possible causes of this undesirable phenomenon, it has been found that in a bulky treatment utilizing a pressurized heated fluid, thermal shrinkage of yarn is caused in, for example, a heated fluid jetting nozzle and, since the variation of the degree of this thermal shrinkage is very large, the dyeability is remarkably changed depending on the degree of this thermal shrinkage. Even if the temperature of the fluid fed to the nozzle can be maintained at a certain level, complicated changes in the streams of the fluid owing to deviations among nozzles cannot be controlled. Therefore, uneven dyeability cannot be eliminated according to the conventional techniques.

To attain the primary object of the present invention, such unevenness of the quality, especially dyeability owing to the thermal shrinkage inherent in the bulky treatment, is controlled and eliminated by maintaining the yarn tension in the drafting zone at a certain level. It is believed that the principle of this control is as follows.

When a yarn having a denier $D_0$ is fed to a heated fluid jetting nozzle at a certain speed $V_1$, the yarn is thermally shrunk by S% in the nozzle and an apparent denier of the yarn increases to an increased denier $D_1$. Simultaneously, crimps, loops and slacks or entanglements are created in the individual filaments of the yarn. Then, the yarn is drafted at a constant ratio E, which is sufficient to eliminate such loops and slacks in individual filaments, in a drafting zone, for example, between a cooling roller and a stretch roller. The tension imparted to the yarn depends upon the type of yarn and is normally in hundreds of grams. If the speed of the yarn thermally shrunk in the nozzle is designated as $V_2$ and the surface speed of the stretch roller is expressed as $V_3$, the following relation is established.

$$S = \frac{V_1 - V_2}{V_1} \times 100 = \frac{D_1 - D_0}{D_1} \times 100\ (\%)$$

$$V_2 = V_1\left(1 - \frac{S}{100}\right)$$

Accordingly, the constant drafting ratio E is expressed as:

$$E = \frac{V_3 - V_2}{V_2} \times 100 = \left[\frac{V_3}{V_1(1 - S/100)} - 1\right] \times 100\ (\%)$$

Therefore, if speeds $V_1$ and $V_3$ are constant values, the constant drafting ratio E is exclusively dominated by the degree S of thermal shrinkage in the nozzle.

More specifically, as the thermal shrinkage in the nozzle is large, the ratio of the draft is increased and hence, the yarn tension is increased. When the thermal shrinkage in the nozzle is small, the ratio of the draft is decreased and hence, the yarn tension is reduced.

In the case where the feed roller located upstream of the heated fluid jetting nozzle is a heating roller, the degree of thermal shrinkage of the yarn in the nozzle is influenced also by the temperature of this heated feed roller. Accordingly, if the temperature of the heated feed roller and the thermal factors (temperature and pressure) of the pressurized heated fluid in the nozzle are increased, the degree of thermal shrinkage of the yarn in the nozzle is increased and the yarn tension in the zone of constant draft is also increased. Consequently, the possible variation of the dyeability of the textured yarn, which mainly depends upon the variation of the thermal-shrinkage of the individual filaments of the yarn, can be effectively controlled by regulating the thermal factor of the heated roller, the texturing nozzle or the pressurized heated fluid so as to control the yarn tension in the zone of constant drafting.

The process steps of manufacturing a bulky yarn according to one embodiment of the present invention will now be described with reference to FIG. 1.

Referring to FIG. 1, a multifilament yarn 2 spun from a spinneret 1 is cooled and a spinning oil is applied thereto by an oiling roller 3. Then, the yarn 2 is passed through Godet rollers 4 and 5 and around a passage between a heated feed roller 6 and a separate roller 7, whereby the yarn 2 is drawn and simultaneously preheated. Thereafter, the yarn 2 is immediately introduced to a heated fluid jetting nozzle 8, where the yarn 2 is crimped and entangled, and simultaneously, thermally shrunk. Then, the yarn 2 passes around a cooling roller 9 and is cooled. After that, the yarn is drafted at a certain ratio by a stretch roller 10 and, thereafter, the thus treated yarn 2 is wound on a bobbin so as to form a package 12 by a winder 11. A yarn breakage detector 13 is disposed at a position between the winder 11 and stretch roller 10 to detect yarn breakages, and a yarn cutting device 14 disposed upstream of the Godet roller 4, and provided with a cutter and a yarn sucker is actuated to cooperate with the yarn breakage detector 13.

The control system of the present embodiment has the following structure.

A tension detector 31 is disposed in the drafting zone between the cooling roller 9 and stretch roller 10 to detect the tension in the yarn 2, and an end of a temperature detector 21 is mounted on the nozzle 8 to detect the temperature of the pressurized heated fluid fed to the nozzle 8. A circulation heater 15 is operated in response to the detected tension and temperature so as to control the tension in the yarn 2 in the drafting zone at a certain level.

The structure of this control system will now be described with reference to FIGS. 2A, 3A and 3B.

Figure 2A:
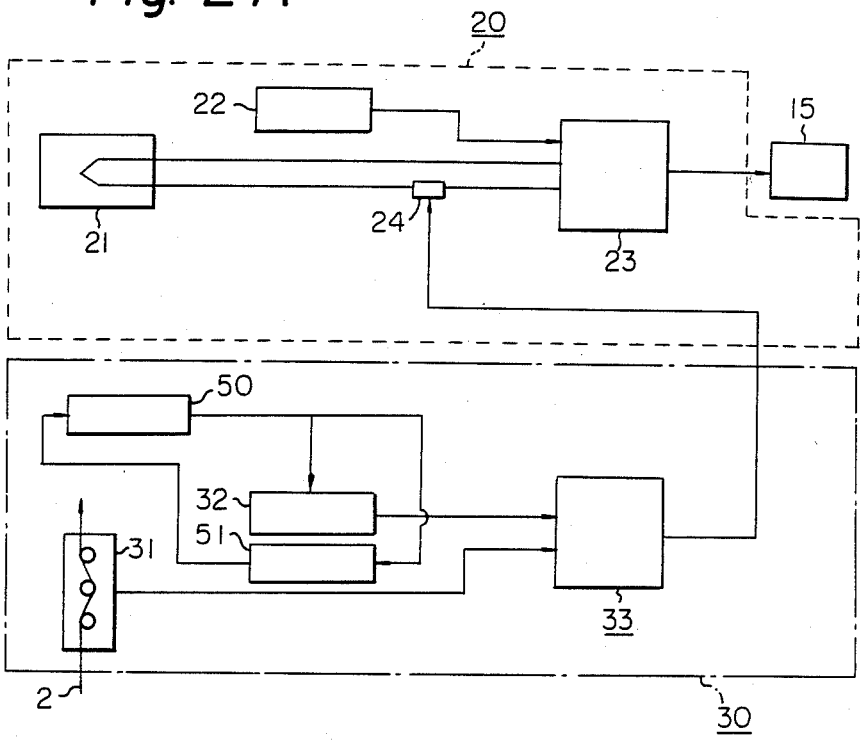
FIG. 2A is a block diagram of an embodiment of a control circuit applied to the texturing apparatus illustrated in FIG. 1.

Referring to FIG. 2A, a temperature control system 20, surrounded by a broken line comprises a temperature detecting end 21, a common temperature setting device 22 and a temperature adjusting meter 23, and this system 20 is arranged so as to control the operation of a circulation heater 15. A tension control system 30, surrounded by a one-dot chain line comprises a common tension setting device 32, a tension detector 31 and a tension adjusting device 33. The tension adjusting device 33 puts out a tension control signal corresponding to the difference between a value of the tension set in, that is a set signal of the tension setting device 32 and the value of the tension detected by the tension detector 31 in the form of an electric current signal, so that a corresponding voltage appears on resistor 24 interposed between the temperature detecting end 21 and the temperature adjusting device 23. This voltage has a value corresponding to the tension control signal, and it is superimposed on a temperature detecting signal in the temperature control system 20. The resulting superimposed signal is input to the temperature adjusting meter 23, so that the total control system, including the temperature control system 20 and the tension control system 30, performs a function of maintaining the tension at a predetermined level in the manner described hereinbelow.

Figure 2B:
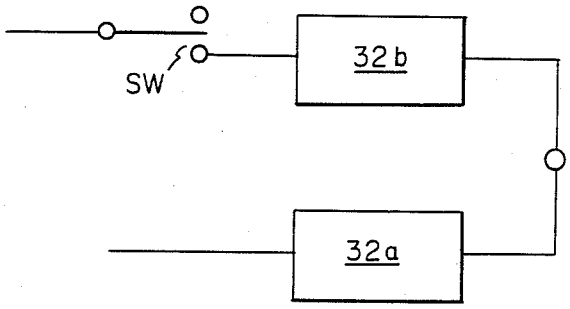
FIG. 2B is a block diagram of the common tension setting device of the control circuit illustrated in FIG. 2A.

As shown in FIG. 2B, the tension setting device 32 comprises a steady setting circuit **32*a* and a circuit 32*b* for additionally elevating the temperature of the heating roller 6 (FIG. 1). The additional elevating circuit 32*b* is operated by a switching means Sw. The outputs of the steady setting circuit 32*a* and the additional elevating circuit 32*b* are summed and the obtained signal is applied to the tension adjusting device 33**.

Figure 2C:
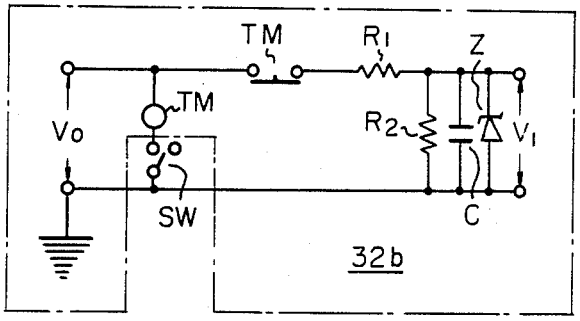
FIG. 2C is a diagram showing the electric circuit of an additionally elevating circuit involved in the control circuit illustrated in FIG. 2B.
Figure 2D:
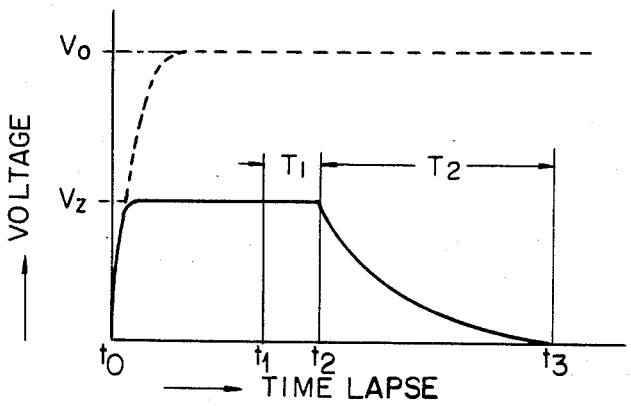
FIG. 2D is a diagramatical representation of the relation between the output voltage of the electric circuit illustrated in FIG. 2A versus time.

An example of the additional elevating circuit **32*b* is illustrated in FIG. 2C. The illustrated circuit 32*b* includes a commercially available off delay timer which is energized when a predetermined voltage is applied and is deenergized after a predetermined period of time $T_1$ when the voltage is stopped. A resistor $R_1$ is connected to the timer in sequence. Furthermore, a resistor $R_2$, a capacitor C and a zener diode Z are arranged in parallel to form a well known first stage delay circuit. The time constant determined by the resistance of the resistor $R_2$ and the capacitance of the capacitor C depends on the time period $T_2$ illustrated in FIG. 7. As is well known, the zener diode Z retains the output voltage of the circuit 32*b* at a predetermined zener voltage $V_z$ (FIG. 2D), even if the input voltage $V_o$ exceeds the zener voltage $V_z$. The zener voltage $V_z$ depends on the additionally elevated tension in the yarn. The construction of the steady setting circuit 32*a*** is well known to a person skilled art, therefore the detailed explanation thereof is omitted.

When the switching means Sw of the elevating circuit **32*b* is closed, an input voltage which is much higher than the zener voltage $V_z$ is applied to the input terminal of the additional elevating circuit 32*b* at time $t_0$ (FIG. 2D) and the timer is simultaneously energized, and then, the capacitor C is charged through the resistor $R_1$. The output voltage $V_1$ of the elevating circuit 32*b* is rapidly elevated, however, when the output voltage $V_1$ exceeds the zener voltage $V_z$ (FIG. 2D), the zener diode Z serves to maintain the output voltage $V_1$ at the zener voltage $V_z$, as illustrated by the solid curve in FIG. 2D. Since the output voltage of the additional elevating circuit 32*b* is applied to the tension adjusting device 33 together with the output of the steady setting circuit 32*a*, the temperature of the heating roller 6 (FIG. 1) is elevated by a predetermined value. Under this condition, a yarn is threaded, and then, after completion of the threading operation, at the time $t_1$ in FIG. 2D, the switching means Sw illustrated in FIGS. 2B and 2C is opened. After a time period $T_1$ has lapsed after the switching means Sw is open, the timer is deenergized. Accordingly, the voltage charged in the capacitor C is gradually discharged through the resistor $R_2$ in accordance with the solid curve in FIG. 2D, and after the time period $T_2$ has lapsed, at the time $t_3$, the output voltage of the additional elevating circuit 32*b*** becomes zero.

Therefore, it should be noted hence that the above control system is one modification of a known method ordinarily called "cascade control" in the art of automatic control. In the ordinary cascade control, the set value of a minor control system is changed by the control output of a main control system. In the present embodiment, the control output of the tension control system 30 corresponding to the main control system, is superimposed on the input of the temperature control system 20, corresponding to the minor control system, and in this point the present embodiment is different from the ordinary cascade control, but both are in agreement with each other with respect to function. Accordingly, the intended primary object of the present invention can be attained even by using a commercially available cascade adjusting meter. However, in order to cope with yarn breakages and facilitate the operation at the time of the starting of the texturing operation, in the present invention, the tension adjusting meter 33 of the tension control system 30 having the following structure is utilized.

Figure 3A:
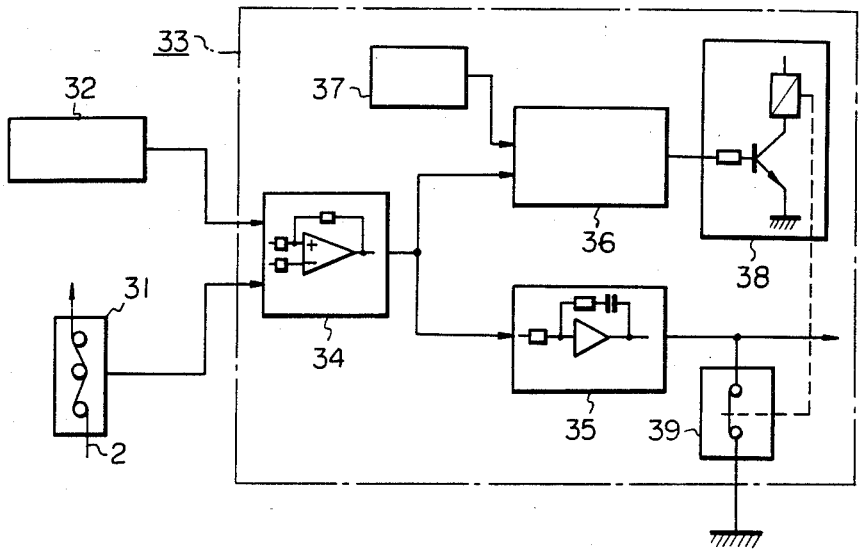
FIGS. 3A and 3B are block diagrams illustrating the tension control system utilized for the embodiment illustrated in FIG. 1, with FIG. 3B being a more detailed drawing of the circuitry shown in FIG. 3A.
Figure 3B:
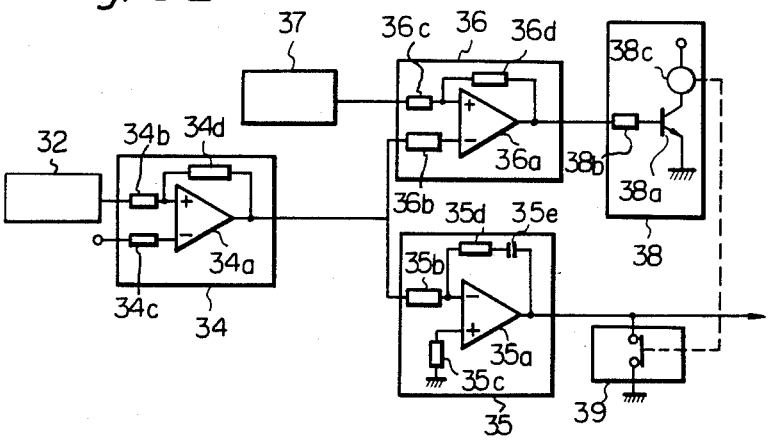

Referring to FIGS. 3A and 3B, the set signal of the common tension setting device 32 and the tension signal issued from the tension detector 31 are input to a deviation circuit 34. Since the deviation circuit 34 is constructed with an operation amplifier **34*a* and resistors 34*b*, 34*c* and 34*d*, so as to be a conventional differentiation circuit, a deviation signal corresponding to the difference between the above-mentioned set signal and the detected tension signal is issued from the deviation circuit 34. This deviation signal is input to an adjusting circuit 35 and a comparison circuit 36. The adjusting circuit 35 is a known circuit for carrying out the proportional and integral operation which comprises an operational amplifier 35*a* and resistors 35*b*, 35*c*, 35*d* and a capacitor 35*e*. Consequently, the above-mentioned deviation signal is converted to a signal created by a proportional and integral operation, that is a signal for controlling the yarn tension. Since the character of the above-mentioned proportional and integral operation affects the result of the tension control operation, it is necessary to carefully decide such character by experimental tests to find pertinent values of the resistors 35*b*, 35*c* and 35*d*, and the capacitor 35*e*, and in some processes, the capacitor 35*e*, which functions as an element for the integral operation, can be omitted from the circuit. On the other hand, the comparing circuit 36 is formed as a differential amplifier circuit which comprises an operational amplifier 36***a*, and resistors 36*b*, 36*c* and 36*d*, like the deviation circuit 34. When the level of the signal issued from the deviation circuit 34 becomes lower than the level of a signal issued from a device for setting an allowable deviation 37, that is, when the level of the tension signal issued from the tension detector 31 becomes remarkably lower, the level of the output signal of the deviation circuit 34 is a positive value. Consequently, a transistor 38*a* of a relay energization circuit 38 becomes positively biased by way of a resistor 38*b*, so that the relay 38*c* is energized, and as a result, a relay contact 39 provided at an output terminal of the adjusting circuit 35 is closed.

The operation of the present embodiment having the above-mentioned structure will now be described. In the normal operation, namely when the multifilament yarn 2 is normally processed by the texturing apparatus and wound on a package by the winding mechanism, the total control system of the present embodiment acts as the cascade control system as pointed out hereinbefore and performs a function of maintaining the yarn tension at a constant level. When a yarn breakage takes place or winding is stopped for the doffing operation, since the tension signal of the tension detector 31 is reduced to zero, the relay actuation circuit 38 is actuated by the comparing circuit 36 to close the relay contact 39. Accordingly, the output of the adjusting circuit 35 of the tension control system 30, namely the above-mentioned tension control signal, is cut off, and the tension control system 30 is separated from the temperature control system 20. Therefore, in the total control system, only the temperature control system 20 acts effectively to maintain the temperature of the pressurized heated fluid at a certain level. If the set value of the temperature control system is set so as to correspond to the set value of the tension, the pressurized heated fluid is kept under normal operation conditions, and therefore, the operation can be started again smoothly after handling of the broken yarn or doffing. Further, there can be attained another advantage in that occurrence of trouble in the equipment caused by excessive elevation of the temperature is effectively prevented. Still further, since control of the temperature at a certain level is automatically changed over to control the tension at a certain level very smoothly with an increase of the tension at the time of starting the operation again after completion of the yarn threading operation, the operation can be remarkably facilitated.

For the reasons set forth above, it will readily be understood that another appropriate means may instead be used to control the temperature of the feed roller or the pressure of the heated fluid.

In another embodiment as disclosed above, the temperature of the feed roller which serves as a preheating roller of the yarn is controlled. A temperature control system substantially the same as the temperature control system 20 illustrated in FIG. 2 and a tension control system the same as that illustrated in FIG. 2 are used. In operation, the sensor 21 senses the temperature of the heating feed roller 6 (FIG. 1). The temperature control system 20 is arranged so as to control the operation of an electromagnetic inductive heater, of a conventional type, which is utilized to heat the heating feed roller 6 (FIG. 1).

In a further embodiment as disclosed above, the pressure of the heated fluid is controlled. A pressure control system which is substantially the same as the temperature control system 20 illustrated in FIG. 2 and a tension control system 30 illustrated in FIG. 2 are used. A sensor which is shown as 21 in FIG. 2 is a pressure sensor arranged so as to detect the pressure of the heated fluid and emit an electrical signal corresponding to the detected pressure. A pressure setting device 22 is used to set a target of the controlled pressure. In this embodiment, the pressure of the heated fluid is controlled in accordance with a control signal emitted from the control system 20 by means of a pressure control valve which has a conventional structure.

Further, in the above-mentioned embodiment, the tension detection signal is used for changing over control of the tension at a certain level so as to control the temperature at a certain level. It will readily be understood that a signal of the operation of the winder or a yarn breakage signal of the yarn breakage detector 13 may be used instead for this changeover. When the signal of the yarn breakage detector 13 is used, there can be attained an advantage that also yarn breakage owing to winding up of the yarn around the stretch roller 10 can be detected.

Accordingly, it is preferred that respective signals be combined so that the operation and maintenance can be facilitated appropriately on the operation system of the texturing apparatus to which the present invention is applied.

In the above-mentioned embodiment, the cascade control system is adopted as the total control system, and from the viewpoint of the control characteristics, a tension control system and a temperature control system are separately provided. However, when the characteristics of both systems are substantially equal to each other, there can be adopted a system in which one common setting device is utilized in such a way that the setting devices 22 and 33 as illustrated in FIG. 4, and the temperature detecting end 21 and the tension detector 31 are exchanged with each other, respectively.

Figure 4:
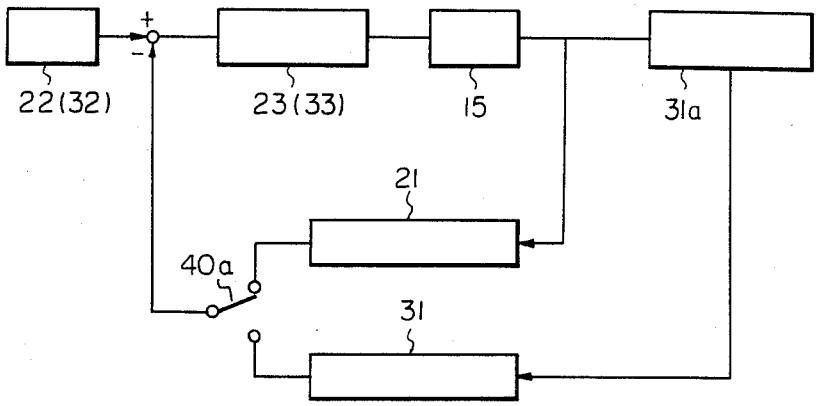
FIGS. 4 and 5 are block diagrams of other embodiments of the control system according to the present invention.

In the block diagram illustrated in FIG. 4, which relates to control of the temperature of pressurized heated fluid, a temperature detecting signal issued from the temperature detecting end 21, which detects the temperature of the pressurized heated fluid, and a tension indicating signal issued from the tension detector 31, which detects the yarn tension, are fed back to the adjusting meter 23 so that a so-called feed back control circuit is formed. Consequently, the tension detector 31 which has been connected to a switching device 40*a* is switched to the temperature detecting end 21 only when an abnormal condition such as when detecting abnormal yarn tension or yarn breakage is detected, and accordingly the constant tension control can be carried out at the time of the steady texturing operation, while the constant temperature control can be carried out at the time of an abnormal condition. As a result, a control effect similar to the embodiment illustrated in FIG. 2A can be obtained. In the above-mentioned block diagram, the transducer part of the tension detector 31 is disposed in the drafting zone 31*a*. Since the structure of the control system characterized by the above-mentioned block diagram is simplified, the installation cost of this control system can be reduced. However, the capacity, that is, the range of utility of this control system, is limited.

Figure 5:
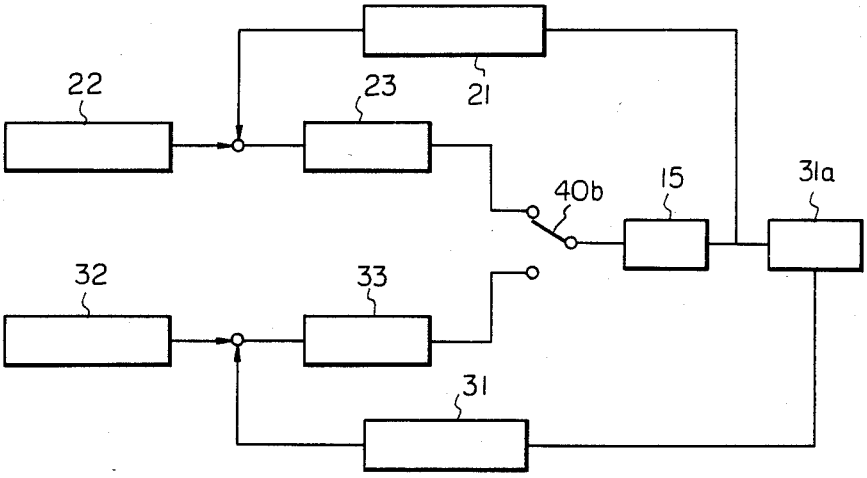

Moreover, a parallel control system as illustrated in FIG. 5 (respective reference numerals indicate the same members as in FIG. 2A) can be adopted in the present invention. That is, in the block diagram illustrated in FIG. 5, which is applied to control the temperature of the pressurized heated fluid, an output terminal of the temperature control system comprising the temperature setting device 22, the temperature adjusting meter 23 and the temperature detecting end 21, and an output terminal of the tension control system comprising the tension setting device 32, the tension adjusing meter 33 and the tension detecting device 31, are connected in such a way that the output signal of the adjusting meters 23, 33 are connected by way of the switching device 40*b*. Consequently, like the embodiment illustrated in FIG. 2A, a tension comparing device is utilized so that the switching device 40*b* is connected to the output of the temperature adjusting meter 23 at the time of detecting an abnormal yarn tension, while the switching device 40*b* is connected to the output of the tension adjusting meter 33 at the time of a steady texturing operation. As a result, according to the control system illustrated in FIG. 5, the constant temperature control is carried out at the time of detecting an abnormal yarn tension, while the constant tension control is carried out at the time of a steady texturing operation. Such control effect is quite similar to the embodiment illustrated in FIG. 2. This control system is slightly inferior to the cascade control system with respect to control characteristics, but the range of utility of this control system is broad, and when the temperature control system has already been installed, since the control system can be completed only by adding the tension control system, there can be attained an advantage that construction expenses can be remarkably reduced over that required for a completely new system.

EXAMPLE

A thermoplastic multifilament yarn of nylon 6 was subjected to a fluid jetting treatment in the direct spin-draw processing equipment as illustrated in FIG. 1. The spun multifilament yarn was adjusted on the Godet rollers 4 and 5 to form a yarn of 800 denier/136 filaments, and the yarn was drawn at a draw ratio of 3.8 by the drawing roller 6 (feed roller) and simultaneously heat-treated at 185° C. for 0.4 second. Immediatley after that, the yarn was introduced into the heated fluid jetting nozzle 8 where crimps and entanglements are created in the individual filaments of the yarn. Superheated steam maintained at 7.5 kg/cm$^2$ and 210° C. was fed to the nozzle 8. An electric current applied to the circulation heater 15 was regulated so that the tension value detected by the tension detecter 31 was constantly 500 g, whereby the tension was maintained at a certain level.

The operation was conducted under the above-mentioned conditions while maintaining the nozzle temperature at a constant level (210° C.) according to the conventional technique and test pieces of the textured yarn were sampled from 30 spindles. The variation of the dyeability among the test pieces was measured by means of the color meter ND-503DE produced by the Nippon Electronics Industry, according to JIS 8701. The variation of the dyeability of these sample yarns was 5.0 expressed as the difference of brightness $\Delta L$.

In the present invention, adopting the above-mentioned control of tension in a condition of constant level, the difference of brightness $\Delta L$ was 1.0, which was 1/5 of the difference of brightness in the conventional technique mentioned above. Accordingly, when the bulky yarn manufactured according to the present invention was used for producing a carpet or the like, warp streaks were not formed, and a uniform product could be obtained by continuous dyeing or by dyeing with a metal-containing dye. As mentioned above, the problems, which are in volved in the steady operation for continuously manufacturing a bulky textured yarn from a thermoplastic multifilament yarn by utilizing pressurized heated fluid, can be effectively solved by the above-mentioned automatic system for regulating the temperature of the heated fluid so as to control the tension of the textured yarn in the yarn passage at a position downstream of the process of texturing the supplied multifilament yarn. However, to provide the most practical method to texture the supplied multifilament yarn, in addition to the first problem, it is necessary to solve the above-mentioned second problem.

The inventors of the present invention have studied the possible causes creating the above-mentioned second problem involved in the initial operation for threading the supplied multifilament yarn through the predetermined yarn passage of the texturing process, and as the result of their study, it was found that the problem, due to the variation of the surface temperature of the heating roller based upon either conditions whether a thread is passing around the heating roller or not, is the most important subject matter to solve the above-mentioned second problem.

Therefore, a detailed study has been conducted on the above-mentioned subject matter related to the variation of the surface temperature of the heating roller.

Figure 6:
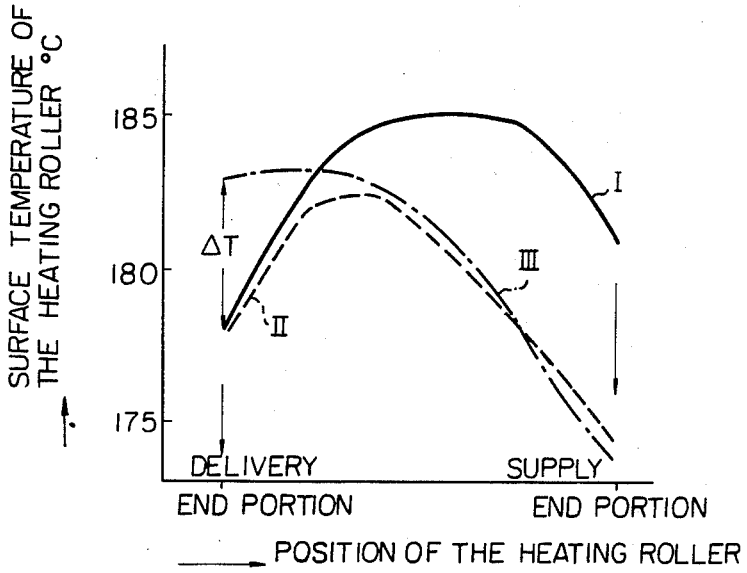

Referring to FIG. 1, it is known that the surface temperature of the heating roller 6 varies in such a manner that the surface temperature at the middle portion thereof is the highest and gradually decreases toward the two end portions of the roller 6, if the yarn 2 is not threaded into the yarn passage around the roller 6, as illustrated by the curved solid line I in FIG. 6. It was found that, if a yarn 2 is heated by the heating roller 6, the surface temperature of the roller 6 is first changed to a condition represented by the dashed-line II, and then gradually changed to the condition represented by the dot-dash line III in FIG. 6, and finally, the temperature distribution of the roller 6 is maintained in the condition represented by line III shown in FIG. 6. As mentioned above, it was found that the difference of the surface temperature of the roller 6 at the end portions of the roller 6 when the yarn 2 is introduced thereto, between a time of threading the yarn to the roller 6 and a time after the texturing operation of the yarn 2 became a steady condition, is $\Delta T$, and such difference of the surface temperature of the roller 6 mainly causes the above-mentioned second problem. Such difference of the surface temperature is more distinguished in the case where the surface temperature of the heating roller 6 is higher, for example a temperature higher than 140° C., such as a temperature in a range between 160° C. and 200° C.

According to repeated experimental tests conducted by the inventors based upon the above-mentioned analysis regarding the causes of the second problem, it was found that, if the above-mentioned difference of the surface temperature created in the heating roller is compensated for by applying heat to the heating roller 6 before threading the yarn 2 so as to maintain the setting of the temperature thereof $\Delta T$ higher than the setting temperature for operating the texturing operation in steady condition, and the possible lowering of the surface temperature of the heating roller 6 due to the opening operation of the exhaust box at the time of threading the yarn 2 and the possible elevation of the separator roller 7 are compensated for so that the surface temperature of the heating roller 6 is gradually returned to the steady condition for texturing the yarn 2, the above-mentioned second problem can be effectively eliminated. According to the above-mentioned experimental tests, the above-mentioned pre-heating of the heating roller 6 is preferably carried out by heating the heating roller 6 at a temperature level ΔT° C. higher than the steady condition. This temperature level ΔT is preferably not lower than 5° C. The time required for gradually approaching the steady condition should preferably not be shorter than 60 sec. The above-mentioned variation of the surface temperature created in the heating roller 6 depends mainly upon the absorption of heat by the yarn 2 passing around the heating roller 6, and it was found that, if a multifilament yarn having a large thickness of more than 800 denier is treated, the above-mentioned phenomenon is most clearly observed. In addition to the thickness of a yarn, the running speed of the yarn 2 is also a distinguished cause to affect the above-mentioned variation of the surface temperature of the heating roller 6. That is, since the quantity of heat absorbed by the yarn 2 passing around the heating roller 6 is increased in accordance with the increase of the running speed of the yarn 2, the above-mentioned variation of the surface temperature of the heating roller 6 becomes more distinguished as the running speed of the yarn 2 increases.

According to experimental tests conducted by the inventors, it is preferable to choose the above-mentioned compensation for the temperature difference in a condition higher than 5° C., which is almost equal to the temperature drop of the surface temperature of the heating roller 6 at the position adjacent to the free end of the roller 6 where the supply yarn 2 is delivered to the member located at the downstream position of the yarn passage. The above-mentioned compensation of the temperature is hereinafter referred to as a temperature shifting for compensation. According to our experimental tests conducted by the inventors, it is preferable to choose the temperature shifting for compensation in a range between 10° and 20° C., so as to equalize the dyeability of the processed yarn produced at the time of threading the yarn 2 through the texturing apparatus. The heating of the heating roller 6 in the condition of the above-mentioned temperature shift for compensation is gradually lowered to the steady condition in accordance with the stabilization of the distribution of the temperature on the surface of the heating roller 6, the temperature elevation of the separate roller 7, the temperature elevation of the atmosphere in the exhaust box 41, the temperature elevation of the texturing nozzle 8..

Figure 7:
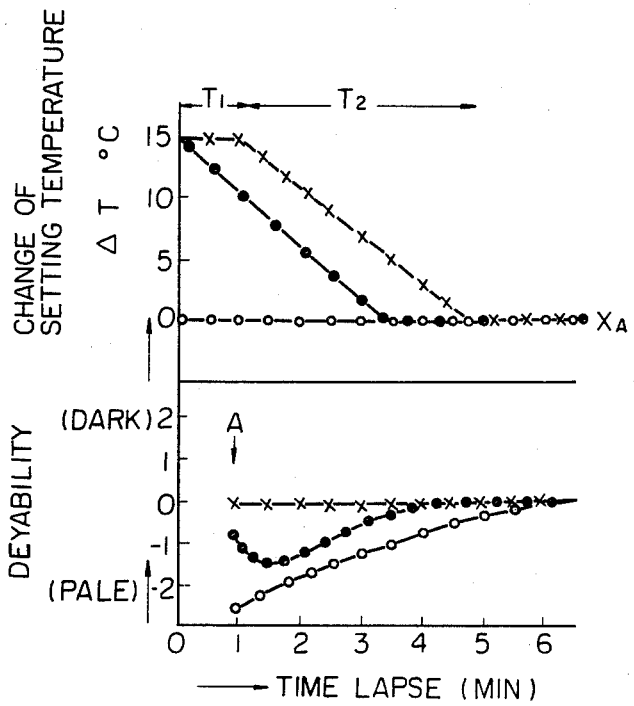

The most preferable control for changing the surface temperature of the heating roller after completion of the threading operation of the yarn 2 through the texturing apparatus is hereinafter explained, with reference to FIG. 7, wherein the abscissa represents a time from the time when the yarn threading operation through the texturing apparatus is completed. For example, O represents the time the yarn threading operation through the texturing apparatus is completed, while A represents the time when the yarn threading operation to a winding device 11 (FIG. 1) is carried out. Therefore, the quality of the yarn produced after the time point A must be guaranteed. The ordinate represents the dyeability (D) of thus produced yarn and also the change of the setting temperature (ΔT) of the heating roller 6 to where the yarn is supplied, that is, in the upper region of FIG. 7 the diagrams represent the relation between T and the lapse of time, while the diagrams in the lower region of FIG. 7 represent the relation between D and the lapse of time. As shown in FIG. 7, if the above-mentioned preheating operation is not applied to the heating roller 6, the surface temperature of the heating roller 6 varies as diagram II shown in FIG. 6, and gradually changes to the condition as represented by the diagram III in FIG. 6. In FIG. 7, such change of the setting temperature of the heating roller 6 is represented by a horizontal line Xa of a level O. As already discussed, the dyeability of the yarn thus produced is very poor, even after the time point A, but the dyeability of the yarn is gradually improved in accordance with approaching the temperature condition of the heating roller 6 to the condition represented by the diagram III in FIG. 6, and changed to a desired level as represented by O level in FIG. 7 after a certain lapse of time, for example 5 or 6 minutes after the time point O. Therefore, the yarn produced in the period when the dyeability thereof is changing cannot be used. By applying the temperature shifting operation to the heating roller 6, the above-mentioned problem can be solved, however, if the temperature shifting operation to the heating roller 6 is finished at the time point O, since the setting temperature of the heating roller 6 is lowered to the O level before the temperature of the heating roller 6 is in a steady condition thereof, the dyeability of a thus produced yarn is weakened and thereafter gradually approaches to the desirable condition represented by O level. To prevent such problem, it is necessary to maintain the temperature shifting operation for a certain period $T_1$ after the time point O, and then the temperature of the temperature shifting operation is gradually lowered to the condition of O level in a certain period $T_2$. If the above-mentioned periods $T_1$, $T_2$ are suitably chosen, the above-mentioned problem related to the dyeability of the yarn thus produced can be eliminated. According to experimental tests conducted by the inventors, it was found that $T_1$ should be chosen at a condition not shorter than 10 sec., preferably in a range between 30 sec. and 2 minutes, while $T_2$ should be chosen so that it is not shorter than a certain time which is preferably in a range between 3 minutes and 10 minutes. In the diagram shown in FIG. 7, the shifting temperature T is linearly lowered, however, in practice, if the shifting temperature T is gradually lowered, the lowering rate of the shifting temperature T per unit time (minute) is not an important factor to eliminate the problem of dyeability of a thus produced yarn.

When the surface temperature of the heating roller is controlled, a control signal due to the above-mentioned program, characterized by $T_1$ and $T_2$ is applied to a temperature-controller (not shown) of the heating roller 6 so as to change the shifting temperature T. That is, in the operation for controlling the surface temperature of the heating roller 6, the surface temperature of the heating roller 6 is additionally elevated to a desired temperature, which is higher than the steady condition thereof, by a suitable means, such as a switching means 50 (FIG. 2) before carrying out the threading operation of the supplied yarn 2 through the texturing apparatus. Then, after completion of the above-mentioned threading operation, the switching means 50 is switched off, so as to maintain the shifting temperature for the predetermined period $T_1$ by way of a timer 51, and then the surface temperature of the heating roller 6 is gradually lowered to the steady condition represented by the O level line. Since a conventional switching means and timer can be easily used for the above-mentioned elements for controlling the operation, the detailed explanation thereof is omitted.

The method for manufacturing the bulky textured multifilament yarn according to the present invention can be applied to any thermoplastic multifilament yarn, for example a polyamide yarn such as nylon 6, nylon 66, a polyester yarn such as polyethylene-terephthalate yarn, polybuthyleneterephthalate yarn, a polyolefin yarn such as polypropylene yarn, polyethylene yarn, a polyvinyl compound yarn such as polyacrylonitrile, polyvinyl-chloride yarn.

As to the texturing process for producing a bulky yarn by utilizing a pressurized heated fluid, the method for applying a jet stream of a heated fluid disclosed in Japanese Patent Publication Showa 44 (1969)-13226, the Japanese Patent Publication Showa 46 (1971)-23776, or the stuffing method for applying heated fluid disclosed in the Japanese Laid Open Specification Showa 50 (1975)-89658 etc. may be applied to attain the purpose of the present invention.

Further, the method for manufacturing the bulky textured multifilament yarn according to the present invention is applied to treatment of a conventional drawn multifilament yarn by utilizing a pressurized heated fluid as well as applied to the so-called direct draw texturing process (DTY) or the so-called the spin-direct draw-texturing process (SDTY).

As mentioned hereinbefore, the method for manufacturing a bulky textured multifilament yarn according to the present invention is characterized by controlling the yarn tension in a passage between the texturing process and winding process in a predetermined value so that the quality of the processed yarn, particularly the dyeability of the yarn, can be maintained in a predetermined uniform condition. Such control principle is quite different from the known system wherein the factors such as the temperature of the heating roller, the temperature of the pressurized heating fluid, and the pressure of the heating fluid are separately controlled in the respective desired condition. In the present invention, the temperature of the heating roller at the time of threading the supplied yarn is effectively controlled so as to eliminate the problem related to the dyeability of the yarn produced in the period of the above-mentioned threading operation, and consequently, the production loss of the yarn at the time of threading operation can be effectively eliminated. As will be clear from the above discussion, the method for manufacturing the bulky textured multifilament yarn according to the present invention remarkably contributes to the related textile industry.

We claim:

1. In an apparatus for manufacturing a bulky textured yarn from a thermoplastic synthetic multifilament yarn, said apparatus being provided with means for texturing said multifilament yarn comprising means for preheating said multifilament yarn, means for treating said preheated yarn with pressurized heated fluid to create bulkiness therein, and means for drafting said textured yarn with a constant rate of draft in a drafting zone downstream of said texturing means, the improvement comprising:

a tension detector for detecting the yarn tension in said drafting zone;

a tension setting device for setting a predetermined value of said yarn tension in said drafting zone;

means for detecting deviation between a value of said yarn tension detected by said tension detector and a set value of said tension setting device;

control means for controlling at least one treatment condition which effects thermal shrinkage of said yarn while being processed by said texturing means; and adjusting means for issuing a control signal corresponding to an output signal of said deviation detecting means, an output of said adjusting means being connected to said control means, whereby when said yarn tension detected by said tension detector deviates from said set value thereof, said control means is controlled by the control signal issued from said adjusting means, so that at least one of said treatment conditions of said texturing means is adjusted in accordance with said control signal of said adjusting means, and said yarn tension can be maintained at a desired condition corresponding to said set value thereof.

2. An apparatus for manufacturing a bulky textured yarn according to claim 1, further comprising a switching means for selectively connecting said adjusting means to said control means.

3. An apparatus for manufacturing a bulky textured yarn according to claim 2, further comprising a device for setting a range of an allowable condition of signal issued from said deviation detecting means, means for comparing said signal issued from said deviation detecting means to said allowable condition set by said setting device, whereby when said means for comparing issues a signal indicating a condition that a signal issued from said deviation detecting means is not within said range of said allowable condition, said adjusting means is disconnected from said control means, while when said tension detector detects that said yarn tension is within said range, said adjusting means is connected to said control means.

4. In an apparatus for manufacturing a bulky textured yarn from a thermoplastic synthetic multifilament yarn, said apparatus being provided with means for texturing said multifilament yarn comprising means for preheating said multifilament yarn, means for treating said preheated yarn with pressurized heated fluid to create bulkiness therein, and means for drafting said textured yarn with a constant rate of draft in a drafting zone downstream of said texturing means, the improvement comprising:

control means for controlling the temperature of said fluid;

a temperature setting device for setting a predetermined value of temperature of said fluid;

a temperature detector for detecting the temperature of said fluid;

temperature adjusting means for supplying a temperature signal to said control means to control the temperature of said fluid in response to said temperature setting device and said temperature detector;

a tension setting device for setting a predetermined value of said yarn tension in said drafting zone;

a tension detector for detecting the yarn tension in said drafting zone;

tension adjusting means for supplying a tension signal to said control means to control the temperature of said fluid in response to said tension setting device and said tension detector; and switch means for selectively supplying said temperature signal to said control means when abnormal yarn tension is detected and supplying said tension signal to said control means when normal yarn tension is detected.

5. In an apparatus for manufacturing a bulky textured yarn from a thermoplastic synthetic multifilament yarn, said apparatus comprising:

means for texturing said multifilament yarn including means for preheating said multifilament yarn, means for treating said preheated yarn with pressurized heated fluid, means for controlling the temperature of said fluid; and means for drafting said textured yarn at a constant rate of draft in a drafting zone downstream of said texturing means;

the improvement comprising:

tension detector means for detecting a yarn tension in said drafting zone;

temperature detector means for detecting the temperature of the fluid;

switch means for switching said tension detector means in a feedback path to said means for controlling when said detected tension is at least equal to a preset tension and for switching said temperature detector means in a feedback path to said means for controlling when said detected tension is less than said preset tension.

* * * * *